US007328919B2

(12) United States Patent
Weinstein

(10) Patent No.: US 7,328,919 B2
(45) Date of Patent: Feb. 12, 2008

(54) SYSTEM AND METHOD TO REDUCE UNCERTAINTY IN PROCURING OVER-THE-COUNTER MEDICATION

(76) Inventor: Robert E. Weinstein, 177 Commonwealth Ave., Boston, MA (US) 02116

( * ) Notice: Subject to any disclaimer, the term of this patent is extended or adjusted under 35 U.S.C. 154(b) by 277 days.

(21) Appl. No.: 10/418,229

(22) Filed: Apr. 17, 2003

(65) Prior Publication Data

US 2004/0174011 A1 Sep. 9, 2004

Related U.S. Application Data

(63) Continuation-in-part of application No. 10/382,388, filed on Mar. 6, 2003, now Pat. No. 7,017,748.

(51) Int. Cl.
*B42D 15/00* (2006.01)

(52) U.S. Cl. ..... 283/67; 283/115; 206/459.1

(58) Field of Classification Search ..... 283/61, 283/62, 115, 117, 900, 67; 206/459.1, 459.5, 206/538

See application file for complete search history.

(56) References Cited

U.S. PATENT DOCUMENTS 4,159,129 A * 6/1979 Lockhart ..... 462/67
4,752,087 A * 6/1988 Weisbach ..... 283/67
4,815,767 A * 3/1989 Lambert ..... 283/67
4,976,351 A * 12/1990 Mangini et al. ..... 206/232
5,031,937 A * 7/1991 Nellhaus ..... 283/52.1
5,048,870 A * 9/1991 Mangini et al. ..... 283/81
5,102,169 A * 4/1992 Mayfield ..... 283/115
5,261,702 A * 11/1993 Mayfield ..... 283/115
5,642,906 A * 7/1997 Foote et al. ..... 283/67
5,752,723 A * 5/1998 Robertson ..... 283/67
5,758,096 A * 5/1998 Barsky et al. ..... 705/3
5,961,151 A * 10/1999 Tung et al. ..... 283/56
6,036,231 A * 3/2000 Foote et al. ..... 283/67

OTHER PUBLICATIONS

Lucian L. Leape, MD et al., Systems Analysis of Adverse Drug Events, JAMA, Jul. 5, 1995, pp. 35-43, vol. 274, No. 1.

* cited by examiner

*Primary Examiner*—Dana Ross
(74) *Attorney, Agent, or Firm*—Robert R. Deleault, Esq.; Mesmer & Deleault, PLLC

(57) ABSTRACT

A system to reduce error in procurement of over-the-counter medications that has a prescription drug dispensing container that contains a prescription medication, an over-the-counter drug dispensing container that contains an over-the-counter medication, indicia displayed on the over-the-counter drug dispensing container, and a procurement guide that links the procurement of the over-the-counter medication to the procurement of said prescription medication and allows identification of said over-the-counter medication by matching indicia on the procurement guide to the indicia on the over-the-counter drug dispensing container.

17 Claims, 2 Drawing Sheets

SYSTEM AND METHOD TO REDUCE UNCERTAINTY IN PROCURING OVER-THE-COUNTER MEDICATION

This application is a continuation-in-part of U.S. patent application Ser. No. 10/382,388 filed Mar. 6, 2003 now U.S. Pat. No. 7,017,748.

BACKGROUND OF THE INVENTION

1. Field of the Invention

The present invention relates generally to drug packaging. Particularly, the present invention relates to drug packaging systems and methods to reduce adverse drug events.

2. Description of the Prior Art

The manufacture and distribution of human drugs in the United States is regulated by the Food and Drug Administration (FDA). The FDA is charged with assessing all drugs for safety and efficacy and is also responsible for determining whether individual drugs are best distributed by prescription or over-the-counter. Prescription drugs, because of toxicity or other potentiality for harmful effect, or the method of its use, or the collateral measures necessary to its use, are considered by the FDA as being not safe for use except under the supervision of a practitioner licensed by law to administer such drugs. Over-the-counter drugs are drugs that the FDA has considered to have a limited potential for harmful effect sufficient to allow dispensing directly to lay users without the requirement of licensed practitioner supervision.

The FDA prohibits the sale or representation of a prescription drug other than by prescription, and the sale or representation of an over-the-counter drug other than by over-the-counter. A prescription drug is required, at minimum, to bear the symbol "RX only", and is considered misbranded if at any time prior to dispensing its label fails to bear this. An over-the-counter drug is deemed misbranded if at any time prior to dispensing its label bears a prescription symbol. (The statutory authority for the FDA comes from the Federal Food, Drug and Cosmetic Act (the FDCA, 21 U.S.C. 301 et seq.) and this ruling is found in SEC. 503 (b)(4)).

Although administration under the supervision of a licensed practitioner is not required for over-the-counter drugs, FDA regulations do not prohibit practitioners from "prescribing" or recommending over-the-counter drugs to their patients. The terms "prescribe" and "recommend" in reference to over-the-counter drugs, are herein used synonymously. The recommending of over-the-counter drugs by a caregiver may be accomplished verbally or in writing, including writing on an ordinary prescription blank although not filled by the pharmacist in the manner of a prescription drug.

Despite the FDA efforts to regulate the dispensing of drugs, errors in the dispensing of drugs and consequent adverse effects are known to occur even in the most carefully supervised medical environments. For example, in a front page article entitled "Controls were urged before '95 overdose" on Jul. 12, 1996, the Boston Globe reported "a number of adverse events" including the death of a 67 year old patient due to potassium chloride overdose at Boston's Brigham and Woman's Hospital. It was noted that in the previous year Dr. David Bates published a research paper documenting how medications caused injuries to one of every 15 patients admitted to Brigham and Woman's, and Massachusetts General Hospitals over a six-month period. A Brigham and Woman's hospital committee came to recognize that if the hospital pharmacy were to only stock packaged, premixed solutions of potassium chloride, and not stock the current vials of concentrated potassium chloride, this would markedly reduce the chance of a future occurrence. Such a measure to prevent adverse effects can be referred to as a "system change" in the dispensing of the drug.

The extent of such problems is not limited. Three years later, on Nov. 30, 1999 both the Wall Street Journal and USA Today reported study findings of the Institute of Medicine, a private organization established by Congress to provide advice on medical issues. The study found that between 44,000 and 98,000 Americans die each year as a result of medical mistakes made while they are in the hospital, killing more Americans than traffic accidents, breast cancer or AIDS. Deaths were again noted to result from the stocking of drugs that should not be administered to patients unless they are diluted. The report took notice of "systemic flaws that . . . build the opportunity for error into medical practice." A member of the Institute of Medicine committee, Dr. Lucien Leape of the Harvard School of Public Health, called for the nation's health care system to focus upon its systems rather than mistakes of individual caregivers.

In the article "Systems analysis of adverse drug events," (JAMA 1995; 274: 35-43), Dr Leape, et al. reports that "errors in drug use are common, costly and often result in injury." Further, that " . . . traditional efforts at error reduction have focused on individuals and episodes, using training, exhortation, rules and sanctions to improve performance. Human factors specialists and error experts reject this approach, noting that it is more effective to change the system as a whole to reduce the likelihood of accidents." "Poor system design creates 'accidents waiting to happen'." To enhance safety by design, one would want to create a system "to make it difficult for individuals to err."

Over-the-counter drugs are generally considered as safe, but this may be misleading. Over-the-counter drugs are not risk-free. Unanticipated and serious adverse effects from unsupervised use of such common medications such as aspirin (peptic ulcer, intractable asthma) and first-generation antihistamines (industrial and motor vehicle injuries caused by impaired cognition) are well known. Some over-the-counter medications have proven to be clearly unsafe and have been removed because of their hazards. The taking of over-the-counter drugs together, or together with prescription drugs opens the door to unintended redundancy, overdose, and drug interactions.

When a caregiver prescribes a prescription drug to be filled by a pharmacy, the caregiver and patient can be reasonably certain that the patient will obtain the correct drug because of the continuous chain of supervision provided by the prescription-dispensing process. When a caregiver recommends an over-the-counter drug to a patient to be obtained at a pharmacy, the present system by which the FDA allows over-the-counter drugs only to be dispensed in that manner places the burden of correctly obtaining the recommended over-the-counter drug upon the patient. Lacking a continuous chain of professional supervision, there is considerably less certainty that the patient will obtain the correct drug.

For at least the following reasons, the procurement of over-the-counter drugs by lay persons can be considered a system that "creates accidents waiting to happen:"

The over-the-counter shelf is confusing. This is common knowledge, and can be validated by observing individuals attempting to select a cold remedy and having to differentiate between a myriad of products containing different ingredients in various proportions, each ingredient having its own therapeutic and side effects, and each formulation requiring different dosing timing. It is a certainty that individuals make inappropriate choices in selecting cold medications that, at least, result in unanticipated stimulation or unwanted sedation. Industrial accidents, motor vehicle accidents and aeronautical errors have been caused by these medications. Because over-the-counter medications are as readily available as other drug store commodities such as toothpaste and shampoo, individuals may misjudge and trivialize them, mistakenly perceiving them as harmless and without side effects or consider them as less efficacious compared to prescription medications, or even ineffective. If advised by caretakers to treat with over-the-counter medication, such individuals might fail to comply with the use of the medications or not bother to go to the pharmacy to procure them at all.

When a physician recommends a particular over-the-counter drug or brand, it may not be carried by the particular pharmacy used by the patient. If the patient does not find the particular over-the-counter recommended by the caregiver at his or her pharmacy, the patient may attempt to select a product that appears the same, or possibly forego treatment. Alternatively, the patient may seek the advice of a pharmacist. In the United States at present, the advisory services of pharmacists are not uniformly available to patients seeking help. It is often the case for pharmacists to be rushed and fully engaged in filling prescriptions. Even if assistance were fully available, however, the pharmacist would not have the caregiver's comprehensive knowledge of the patient's medical status and full understanding of the rationale for the caregiver's selection of medication.

A branded name may encompass many formulations. As with other retail commodities, over-the-counter drugs compete with each other at the retail shelf. Drug companies frequently develop multiple drug variations under the same brand name and can command increased shelf space in this manner. As an example, a patient suffering with acute sinusitis, who is advised by his or her caregiver to procure "Afrin Nasal Spray®," might find one or more of: "Original", Extra Moisturizing", "Severe Congestion", Allergy", "Sinus", or "Saline Mist" varieties upon reaching the pharmacy. If the "Afrin®" brand is not stocked, the patient might find another brand such as "Neo-Synepherin®", but then have to deduce the utility of "Regular Strength", "Extra Strength", "Mild Formula", and "Extra Moisturizing" preparations. Among these formulations are some with one decongestant, some with another decongestant, and some that have no decongestant at all.

The formulation of an over-the-counter product may change from time to time. It has been estimated that there are over 100,000 non-prescription over-the-counter products and changes can easily escape the caregiver's scrutiny and usually occur without notification to caregivers.

Therefore, what is needed is drug system and method that utilizes prescription and over-the-counter drugs in a coordinated system together to minimize error in patient procurement of over-the-counter medications. What is further needed is a drug system and method that provides greater control of the over-the-counter medications that the caregivers intend for their patients. What is also needed is a drug system and method that reduces the confusion and uncertainty created by the myriad of over-the-counter products from which a patient must differentiate.

SUMMARY OF THE INVENTION

It is an object of the present invention to provide a drug system and method to improve treatments that utilize prescription and over-the-counter drugs together and particularly to minimize error in the procurement of over-the-counter medications by patients in this situation. It is another object of the present invention to afford caregivers increased control of the over-the-counter medications that they intend their patients to receive. It is a further object of the present invention to overcome the confusion and uncertainty created by the myriad of over-the-counter products from which a lay user has to differentiate. It is still another object of the present invention to provide prescription drug and over-the-counter medication in packaging such that the dispensing packaging of the prescription drug may be linked to the dispensing packaging of the over-the-counter drug by indicia that serves to guide a user to procure the over-the-counter drug. It is yet a further object of the present invention to link the procurement of a specific over-the-counter medication by a patient to the more certain procurement of a prescription drug.

The present invention achieves these and other objectives by providing a therapeutic system comprising a prescription medication in a dispensing container, an over-the-counter medication in a dispensing container and a prescription and over-the-counter medication regimen procurement guide linking the procurement of the over-the-counter medication to the procurement of the prescription medication. The present invention is based upon the insight that when a combination of medications (one obligatorily dispensed by prescription and another obligatorily dispensed over-the-counter) are the intended treatment of a caregiver, the prescription drug process can be harnessed to improve the certainty of the patients procuring the intended over-the-counter drug. The present invention links the procurement of the over-the-counter drug to the more certain process of dispensing prescription drugs and, thus, would make it more difficult for individuals to err in choosing the over-the-counter medication. The present invention also affords the caregiver improved control and the patient increased assurance of receiving the intended treatment. The present invention also teaches a therapeutic method in which the regimen procurement guide links procurement of over-the-counter medication to the procurement of a prescription medication and serves to direct the patient to procure the intended over-the-counter drug. By this system, over-the-counter drug selection and procurement can be accomplished with a greater degree of certainty than is presently possible.

The prescription drug is prepackaged in a dispensing container by a manufacturer and the over-the-counter drug is also prepackaged in a dispensing container by a manufacturer. A regimen procurement guide provided by a manufacturer specifies the intended prescription medication, the intended over-the-counter medication, and also has indicia to direct a patient to positively identify the intended over-the-counter drug. The over-the-counter drug also has indicia on the surface of its dispensing container that confirms the selection by the patient of the proper over-the-counter drug.

DETAILED DESCRIPTION OF THE PREFERRED EMBODIMENT

Figure 1:
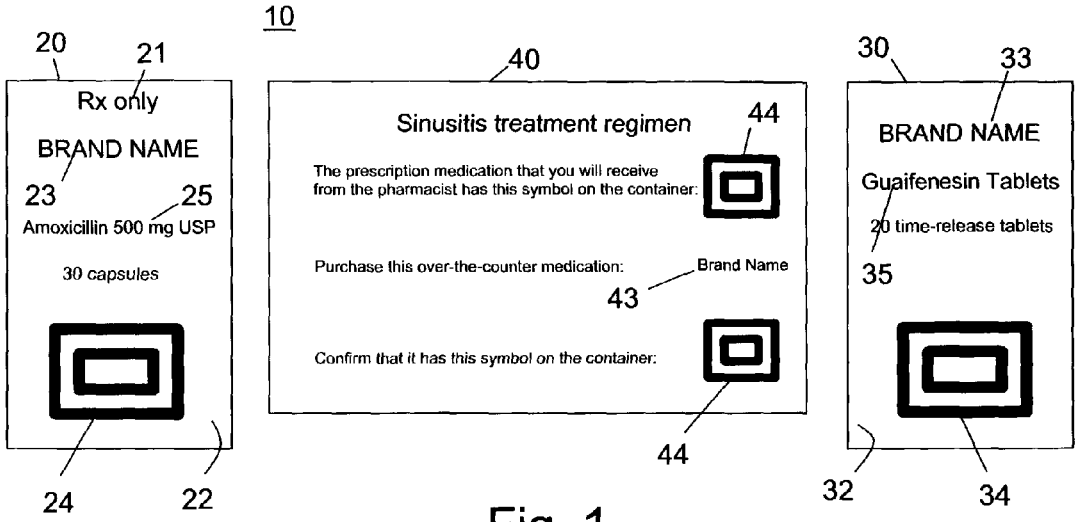
FIG. 1 is a front plan view of one embodiment of the present invention showing a procurement guide.

The preferred embodiment(s) of the present invention are illustrated in FIGS. 1-4. FIG. 1 illustrates front planar views of a drug packaging and procurement system 10. Drug packaging system 10 includes a prescription drug dispensing container 20, an over-the-counter drug dispensing container 30, and a procurement guide 40. Prescription drug dispensing container 20 includes a symbol 21 ("Rx only"), a brand name 23 and a linking indicia 24 on front surface 22. Over-the-counter dispensing container 30 purposely does not have the "Rx only" symbol but includes a brand name 33 and a complementary linking indicia 34 on front surface 32. Both linking indicia 24 and 34 are identical, indicating linkage or commonality. Linking indicia 24 and 34 may be any symbol or shape such as, for example, a double rectangle.

It has been noted that the same brand name may refer to a variety of over-the-counter products with differing active ingredients (for example, "Afrin®"), and that this is a source of confusion for consumers. It is appreciated, however, that prescription drugs are closely regulated, and that the brand name for any prescription drug is necessarily different from the brand name of any over-the-counter drug. To exemplify what is meant herein by "brand name", Amoxil® is a brand name for amoxicillin capsules manufactured by GlaxoSmithKline of Research Triangle Park, N.C. The manufacturer name, GlaxoSmithKline is not meant to refer to a "brand name" of a drug.

FIG. 1 illustrates an embodiment of the present invention. In this example the particular combination of prescription and over-the-counter drugs might be employed by caregivers as a regimen to treat acute sinusitis.

Dispensing containers 20 and 30 depicted in FIG. 1 identify the medication both by brand name 23, 33 and an active ingredient name 25, 35. The dispensing containers each also have indicia 24, 34, in this case a double rectangle figure. The regimen procurement guide 40 instructs the user to purchase the over-the-counter drug by brand name 43 and to confirm with indicia 44 that the dispensing container has a double rectangle symbol on the container. By naming the over-the-counter product by brand name 43 and depicting the double rectangle indicia 44, the regimen procurement guide 40 acts to guide the user to the intended over-the-counter drug and positively confirm its selection. Purchase of over-the counter-medication is linked to the purchase of a prescription medication and the appearance of the double rectangle indicia 24 on the prescription drug in this instance may serve as an on-site back up or reinforcement at the pharmacy for directing over-the-counter purchase.

It is preferable for a caregiver to direct a patient to a desired over-the counter drug in this manner as compared to verbal or ordinary written instruction. Verbal instructions can be misunderstood or misinterpreted. Even with ordinary written instructions a patient may fail to obtain the intended medication at the over-the-counter shelf because of the aforementioned problems with selecting over-the-counter medicines. In providing the patient the regimen procurement guide 40, the chances for the patient to select the intended over-the-counter medication is greatly improved compared to its being conventionally recommended.

FIG. 1 is intended to illustrate box-type containers of the kind ordinarily used to package medications, but employment of container bottles, tubes, blister cards and other medication containers, as is known in the art, are within the scope of this invention. It is also to be understood that symbols such as designs, words, colors, package shapes, and other indicia other than those illustrated in FIG. 1 can serve in the same manner to direct procurement of the intended package, and that such indicia are within the scope of this invention. It is anticipated that the manufacturer's name or trade logo might be used as distinguishing indicia in combination with the procurement indicia, however this is considered less desirable, particularly in the instance that such indicia is used on other over-the-counter medications and would then confuse the consumer at the over-the-counter shelf.

The manufacturer has considerable control of the system and it is obligatory that the manufacturer does not manufacture additional drugs in dispensing containers with indicia that would cause confusion. It is preferred that the pharmaceutical manufacturer utilize a particular indicia only for a single regimen. Drugs in the form of pills, tablets, capsules and the like are well known in the art to be prepackaged by manufacturers for users in sealed formats such as bottles or blisters. The devising and manufacture of prepackaged prescription and over-the-counter drugs in the manner of the present invention requires expertise at least commensurate with that of a pharmaceutical manufacturer.

The present invention also provides advantages for the pharmacy. It is common for pharmacists to be required to fill containers with prescription medication prior to dispensing. Both drugs of the present invention are pre-packaged by a manufacturer in an amount intended for procurement by a user. This unit-of-use prescription packaging has the advantage of eliminating the need for a container-filling step by the pharmacist, saving time, cost, and importantly, minimizing potential for error for prescription drugs that ordinarily require filling. The regimen procurement guide 40 of the present invention also alleviates the need for the pharmacist to assist in selecting over-the-counter medication.

Figure 2:
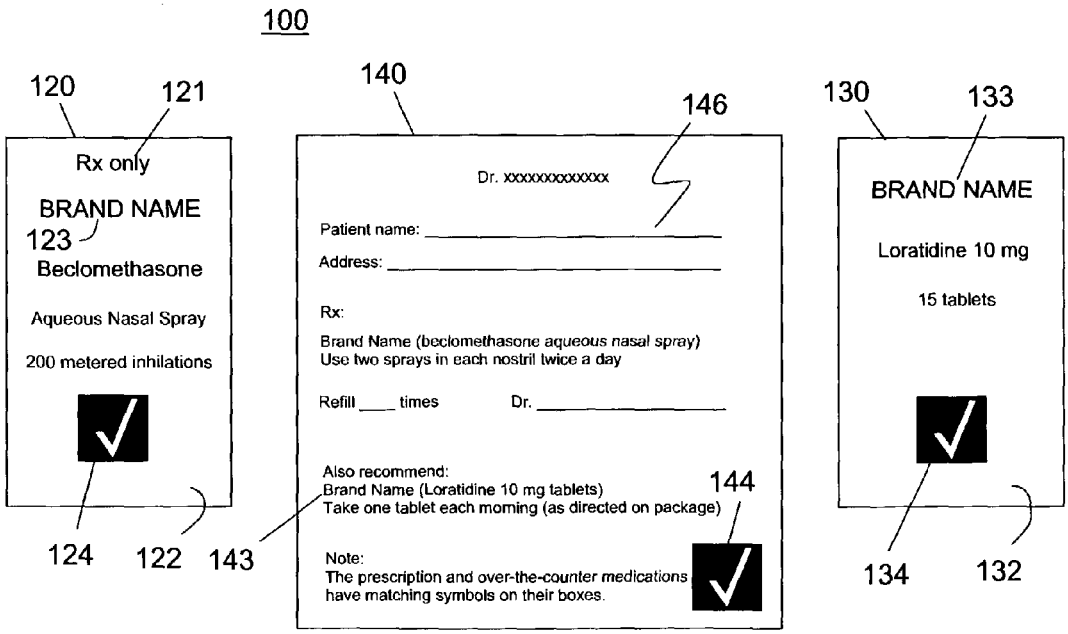
FIG. 2 is a front plan view of another embodiment of the present invention showing a combination prescription form and procurement guide.

Turning now to FIG. 2, there is illustrated another embodiment of the present invention. In this embodiment, the prescription drug is the steroid nasal spray, beclomethasone, and the over-the-counter drug is the antihistamine loratidine. Such a regimen of medications might be used by practitioners to treat allergic rhinitis. In the past both have been prescription drugs. However, loratidine has recently been switched from prescription to over-the-counter status. It is presently sold alone and in formulation with 240 mg of pseudoephedrine in similar packaging.

Pseudoephedrine has known stimulatory and cardiovascular side effects that are of considerable risk in some patients despite being an over-the-counter drug. Pseudoephedrine is contraindicated in narrow angle glaucoma and patients receiving monamine oxidase (MAO) inhibitor therapy. It should be judiciously and sparingly used in hypertension, diabetes mellitus, ischemic heart disease, and renal disease, the latter because of reduced elimination of the drug. Like other sympathomimetic amines, it may and can produce central nervous system stimulation, convulsions, arrhythmias, and cardiovascular collapse. Notably, another over-the-counter sympathomimetic amine, phenylpropanolamine, has now been discontinued because of an increased incidence of stroke in individuals using it. A 240 mg dose of pseudoephedrine is a maximal daily dose and its administration assures persistent adrenergic stimulation. The embodiment in FIG. 2 illustrates how the present invention can control the potential for "an accident waiting to happen" if a hypertensive or stroke-susceptible patient were to inadvertently procure and take 240 mg of pseudoephedrine daily.

FIG. 2 illustrates a drug packaging system 100 that includes a prescription drug dispensing container 120, an over-the-counter drug dispensing container 130, and a procurement guide 140. Prescription drug dispensing container 120 includes a symbol 121 ("Rx only"), a brand name 123 and a linking indicia 124 on front surface 122. Over-the-counter dispensing container 130 purposely does not have the "Rx only" symbol but includes a brand name 133 and a complementary linking indicia 134 on front surface 132.

The regimen procurement guide 140 includes the form of a preformatted prescription 146 that the caregiver would be required to sign in order for the patient to procure the prescription medication. Guide 140 also directs the patient to procure the over-the-counter medication, loratidine, by brand name 143 and to confirm with indicia 144 that the dispensing container has a "check" indicia on the container for matching the prescription and over-the-counter medications. Guide 140 further notes that that matching "check" symbols are on both medication containers.

Figure 3:
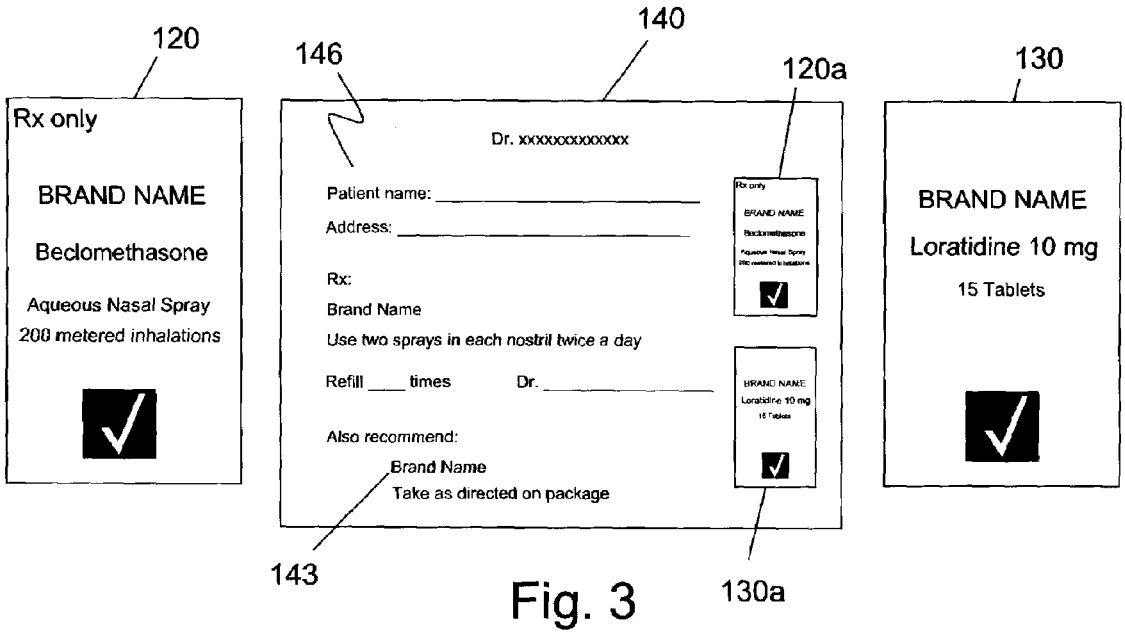
FIG. 3 is a front plan view of another embodiment of the present invention shown in FIG. 2.

FIG. 3 illustrates the same medication containers containing the same medication as shown in FIG. 2. The main difference between the embodiments in FIG. 3 and FIG. 2 is in the regimen procurement guide 140. Similarly, procurement guide 140 includes the form of a preformatted prescription 146 that the caregiver would be required to sign in order for the patient to procure the prescription medication. The regimen procurement guide 140 directs the patient to procure the over-the-counter drug by brand name 143 and, rather than simply displaying only the "check" indicia, includes illustrations 120*a*, 130*a* of the intended prescription and over-the-counter medication containers 120, 130 that include the "check" indicia.

Figure 4:
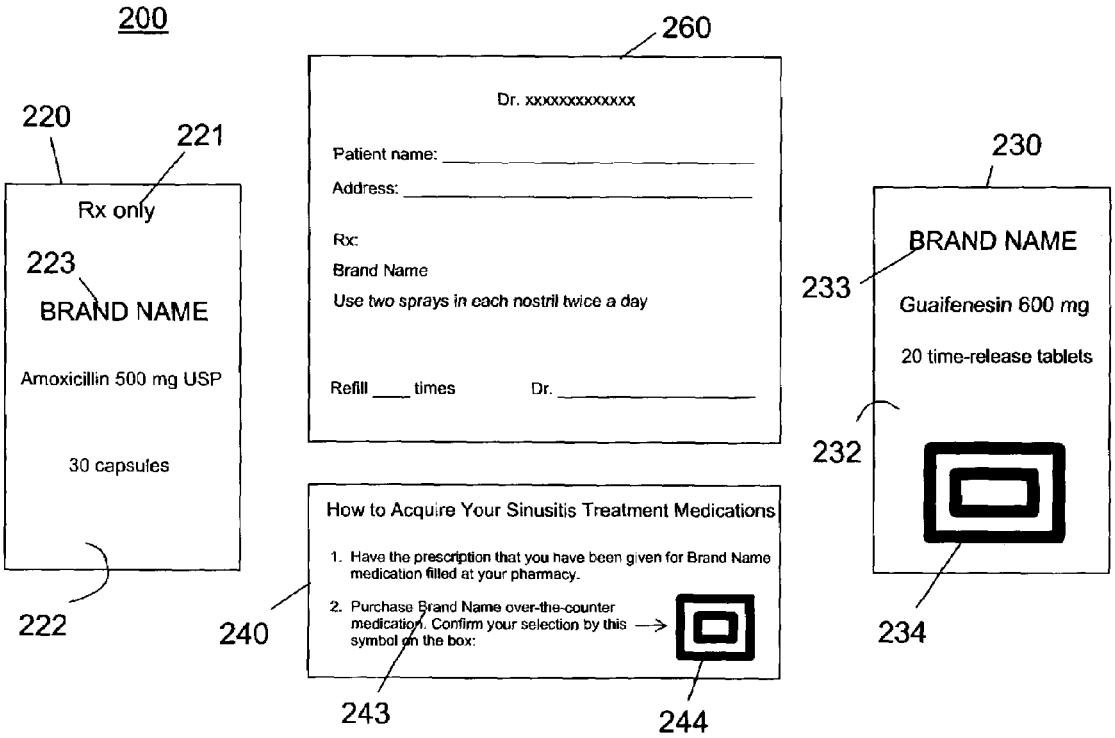
FIG. 4 is a front plan view of another embodiment of the present invention showing a separate prescription form and a procurement guide.

FIG. 4 illustrates similar medication containers containing the same medication as shown in FIG. 1. In this embodiment, a drug packaging system 200 includes a prescription drug dispensing container 220, an over-the-counter drug dispensing container 230, and a procurement guide 240. Prescription drug dispensing container 220 includes a symbol 221 ("Rx only") and a brand name 223 on front surface 222. Over-the-counter dispensing container 230 purposely does not have the "Rx only" symbol but includes a brand name 233 and a linking indicia 234 on front surface 232.

The regimen procurement guide 240, in this embodiment, is separate from the prescription form 260. The guide 240 directs the patient to purchase the prescription drug by brand name and also to purchase the over-the-counter drug 230 by brand name 243, and allows the patient to confirm the selection of the over-the-counter drug 230 by matching double rectangle indicia 244 to the linking indicia 234 on the over-the-counter drug 230. The procurement of intended over-the-counter medication is therefore more certain than if the caregiver were to give the patient oral instructions, or even conventional written instructions.

It has been noted that individuals are known to misjudge and trivialize over-the-counter medications, and in some instances, not bother to go to the pharmacy to procure them at all. For such patients, the linking of over-the-counter medication to the procurement of prescription medication necessitates going to the pharmacy. For some patients, the linking of over-the-counter medication and prescription medication as components of a regimen by the regimen procurement guide may elevate the perception of the over-the-counter medication as an integral part of treatment.

The regimen procurement guide is not necessarily intended to be limited to only specify and link prescription medications, over-the-counter medications and display guiding indicia. The regimen procurement guide might optionally also provide additional incentive to a user to follow through with the acquisition of the intended regimen. For example, discounts, bundled pricing, awards and other benefits are examples of additional incentives that might be utilized to motivate the patient.

Although the embodiments specifically described herein have referred to particular medications, other medications and medication forms are also within the scope of this invention. The dispensing packaging may be adapted by variations in size or shape as needed to incorporate the drugs as may be desired.

Other variations may occur to those skilled in the art which are within the scope of the invention as set forth in the appended claims. Those of skill in the art may also recognize modifications to these presently disclosed embodiments. These variations and modifications are meant to be covered by the spirit and scope of the present claims.

What is claimed is:

1. A medication purchasing identification system that allows a purchaser to identify on an over-the-counter shelf an over-the-counter drug intended by a caregiver to be procured as a caregiver treatment component advised for use together with a prescription medication prescribed by the caregiver, said system comprising:

a prescription medication in a prepackaged dispensing container;

a separate over-the-counter medication in a prepackaged dispensing container, said over-the-counter prepackaged dispensing container being configured for displaying on said over-the-counter shelf and for procuring by the purchaser;

linking indicia on said over-the-counter medication dispensing container designated and displayed by a manufacturer of said over-the-counter medication prior to purchase by the purchaser; and a medication procurement guide having a replica of said linking indicia thereon that links the purchase of said over-the-counter medication to the purchase of said prescription medication wherein said linking indicia facilitates identification by the purchaser of said caregiver-intended over-the-counter medication on said over-the-counter shelf to be procured by the purchaser as said caregiver-intended treatment component advised for use together with said prescription medication.

2. The system of claim 1 wherein said linking indicia is a name, a symbol, a graphic feature or a structural feature and combinations thereof.

3. The system of claim 2 wherein said prescription medication dispensing container includes a replica thereon of said linking indicia of said over-the-counter medication dispensing container.

4. The system of claim 1 wherein said procurement guide further includes a prescription form.

5. An over-the-counter drug selection and guidance system that allows a purchaser to identify on an over-the-counter shelf an over-the-counter drug intended by a caregiver to be procured as a caregiver treatment component advised for use together with a prescription medication prescribed by the caregiver, said system comprising:

a prescription medication prepackaged by a manufacturer in a prescription drug dispensing container;

an over-the-counter medication prepackaged by a manufacturer in an over-the-counter drug dispensing container having a manufacturer-placed linking indicia on at least one surface of said over-the-counter dispensing container prior to purchase by a patient, said over-the-counter prepackaged dispensing container being configured for displaying on said over-the-counter shelf and for procuring by said purchaser; and a medication procurement guide having a replica of said linking indicia thereon that links the purchase of said over-the-counter medication to the purchase of said prescription medication wherein said linking indicia facilitates identification by the purchaser of said caregiver-intended over-the-counter medication on said over-the-counter shelf to be procured as a caregiver-intended treatment component advised for use together with said prescription medication.

6. The selection and guidance system of claim 5 wherein said linking indicia is a name, a symbol, a graphic feature or a structural feature and combinations thereof.

7. The selection and guidance system of claim 6 wherein said prescription medication dispensing container includes a replica thereon of said linking indicia of said over-the-counter medication dispensing container.

8. The selection and guidance system of claim 5 wherein said procurement guide further includes a prescription form.

9. A method to guide the selection of an over-the-counter medication that allows a purchaser to identify on an over-the-counter shelf an over-the-counter medication intended by a caregiver to be procured as a caregiver-intended treatment component advised for use together with a prescription medication, said method comprising:

manufacturing a prescription medication in a prepackaged dispensing container;

manufacturing an over-the-counter medication in a prepackaged dispensing container, said container having manufacturer-placed linking indicia thereon and being configured for displaying on said over-the-counter shelf and for procuring by the purchaser; and manufacturing a medication procurement guide having a replica of said linking indicia thereon that links the purchase of said over-the-counter medication to the purchase of said prescription medication wherein said linking indicia facilitates identification by the purchaser of said caregiver-intended over-the-counter medication on said over-the-counter shelf to be procured as said caregiver-intended treatment component advised for use together with said prescription medication.

10. The method of claim 9 further comprising using a name, a symbol, a graphic feature or a structural feature and combinations thereof as said linking indicia.

11. The method of claim 10 further comprising including a replica of said linking indicia from said over-the-counter medication on said prescription medication container.

12. The method of claim 10 further comprising including a prescription form on said procurement guide.

13. A method to reduce error in the procurement of an over-the-counter drug from an over-the-counter shelf by a patient when said over-the-counter drug is advised for use together with a prescription drug, said method comprising:

prescribing a prescription medication in a dispensing container that has been prepackaged by a manufacturer;

recommending an over-the-counter medication in a dispensing container having manufacturer-placed linking indicia thereon to facilitate identification of said over-the-counter medication on said over-the-counter shelf by the patient; and furnishing the patient with a medication procurement guide having a replica of said linking indicia thereon to facilitate identification of said over-the-counter medication on said over-the-counter shelf by the patient to be procured as said over-the-counter medication advised for use together with said prescription medication.

14. A method of dispensing prescription and over-the-counter medications as caregiver-intended treatment components, said method comprising:

stocking a prescription medication in a dispensing container that has been prepackaged by a manufacturer;

stocking on an over-the-counter shelf an over-the-counter medication in a dispensing container that has been prepackaged by a manufacturer, said dispensing container having manufacturer-placed linking indicia thereon to facilitate identification of said over-the-counter medication on said over-the-counter shelf by a purchaser who has a medication procurement guide containing a replica of said linking indicia, said over-the-counter medication being a caregiver-intended over-the-counter medication to be procured with said prescription medication prescribed by said caregiver as said caregiver-intended treatment components; and filling a prescription for said prescription medication in said prepackaged dispensing container.

15. A medication dispensing system comprising:

a prescription drug dispensing means that contains a prescription medication;

an over-the-counter drug dispensing means that contains an over-the-counter medication;

manufacturer-placed linking means on said over-the-counter drug dispensing means, said over-the-counter drug dispensing means configured for display on an over-the-counter shelf; and procurement guiding means having a replica of said linking indicia means thereon to facilitate identification of said over-the-counter drug dispensing means on said over-the-counter shelf by the patient to be procured with said prescription drug dispensing means prescribed by said caregiver as caregiver-intended treatment components.

16. The system of claim 15 wherein said linking indicia means is a name, a symbol, a graphic feature or a structural feature and combinations thereof.

17. The system of claim 15 further comprising including a prescription form on said procurement guiding means.

* * * * *